US007857170B2

(12) United States Patent
Ophardt

(10) Patent No.: US 7,857,170 B2
(45) Date of Patent: Dec. 28, 2010

(54) WALL PLATE SYSTEM FOR DISPENSERS

(75) Inventor: Heiner Ophardt, Vineland (CA)

(73) Assignee: Gotohti.com Inc., Beamsville, Ontario (CA)

( * ) Notice: Subject to any disclaimer, the term of this patent is extended or adjusted under 35 U.S.C. 154(b) by 1077 days.

(21) Appl. No.: 11/590,862

(22) Filed: Nov. 1, 2006

(65) Prior Publication Data

US 2007/0257061 A1 Nov. 8, 2007

(30) Foreign Application Priority Data

May 2, 2006 (CA) ..... 2545654

(51) Int. Cl.
*B67D 7/06* (2010.01)

(52) U.S. Cl. ..... 222/181.3; 222/181.2

(58) Field of Classification Search ..... 222/180, 222/181.3, 94, 129, 181.2, 173
See application file for complete search history.

(56) References Cited

U.S. PATENT DOCUMENTS

| | | | | |
|---|---|---|---|---|
| 1,933,517 | A | 10/1933 | Tucker | |
| 3,078,016 | A | 2/1963 | Judy | |
| 3,540,630 | A | 11/1970 | Brown et al. | |
| 3,752,365 | A | 8/1973 | Coleman | |
| 4,085,867 | A | 4/1978 | Heller | |
| 4,166,553 | A | 9/1979 | Fraterrigo | |
| 4,228,928 | A | 10/1980 | Hocker et al. | |
| 4,248,398 | A * | 2/1981 | Doyel | 248/220.1 |
| 4,650,095 | A | 3/1987 | Tella et al. | |
| 4,905,873 | A | 3/1990 | Loesel, Jr. et al. | |
| 5,014,880 | A | 5/1991 | Loesel, Jr. et al. | |
| 5,174,476 | A | 12/1992 | Steiner et al. | |
| 5,248,067 | A * | 9/1993 | Garcia | 222/181.2 |
| 5,277,332 | A | 1/1994 | Rogers | |
| 5,421,489 | A | 6/1995 | Holzner, Sr. | |
| 5,452,825 | A | 9/1995 | Comstock et al. | |
| 5,632,418 | A * | 5/1997 | Brown | 222/180 |
| 5,638,989 | A * | 6/1997 | Ophardt et al. | 222/105 |
| 5,649,643 | A * | 7/1997 | Ridgeway | 222/105 |
| 6,131,773 | A * | 10/2000 | Wade et al. | 222/153.02 |
| 6,209,184 | B1 | 4/2001 | Copeland et al. | |
| 6,321,943 | B1 | 11/2001 | Strickler et al. | |
| 6,575,335 | B2 | 6/2003 | Lewis et al. | |
| 6,758,372 | B2 | 7/2004 | Studer | |
| 2002/0074356 | A1 | 6/2002 | Lewis et al. | |
| 2005/0263545 | A1 | 12/2005 | Ophardt | |
| 2009/0114679 | A1 * | 5/2009 | Ophardt et al. | 222/105 |

FOREIGN PATENT DOCUMENTS

| | | |
|---|---|---|
| DE | 1 197 376 | 10/1967 |

(Continued)

OTHER PUBLICATIONS

DE 202 14 347 translation of p. 9, paragraph 4.*

*Primary Examiner*—Kevin P Shaver
*Assistant Examiner*—Robert K Nichols, II
(74) *Attorney, Agent, or Firm*—Riches, McKenzie & Herbert LLP

(57) ABSTRACT

A universal wall plate which can be secured to a wall and to which a variety of dispensers can readily be secured and removed with minimal effort, without the need to remove the wall panel and without causing damage to the wall.

18 Claims, 6 Drawing Sheets

FOREIGN PATENT DOCUMENTS

| | | | |
|---|---|---|---|
| DE | 121 023 | | 2/1975 |
| DE | 121023 | | 7/1976 |
| DE | G 87 01 799.7 | | 7/1987 |
| DE | 89 15 053 | U1 | 3/1990 |
| DE | 202 14 347 U 1 | | 1/2003 |
| DE | 203 13 990 U 1 | | 12/2003 |
| DE | 203 00 378 | U1 | 6/2004 |
| DE | 103 31 786 | A1 | 2/2005 |
| EP | 0 072 260 | A1 | 2/1983 |
| EP | 0072260 | | 2/1983 |
| EP | 0 204 689 | A2 | 12/1986 |
| EP | 1 090 577 | A2 | 4/2001 |
| WO | WO 88/01252 | | 2/1988 |
| WO | WO 92/13795 | | 8/1992 |
| WO | WO 97/31563 | | 9/1997 |
| WO | WO 02/49490 | A1 | 6/2002 |

* cited by examiner

FIG. 3.
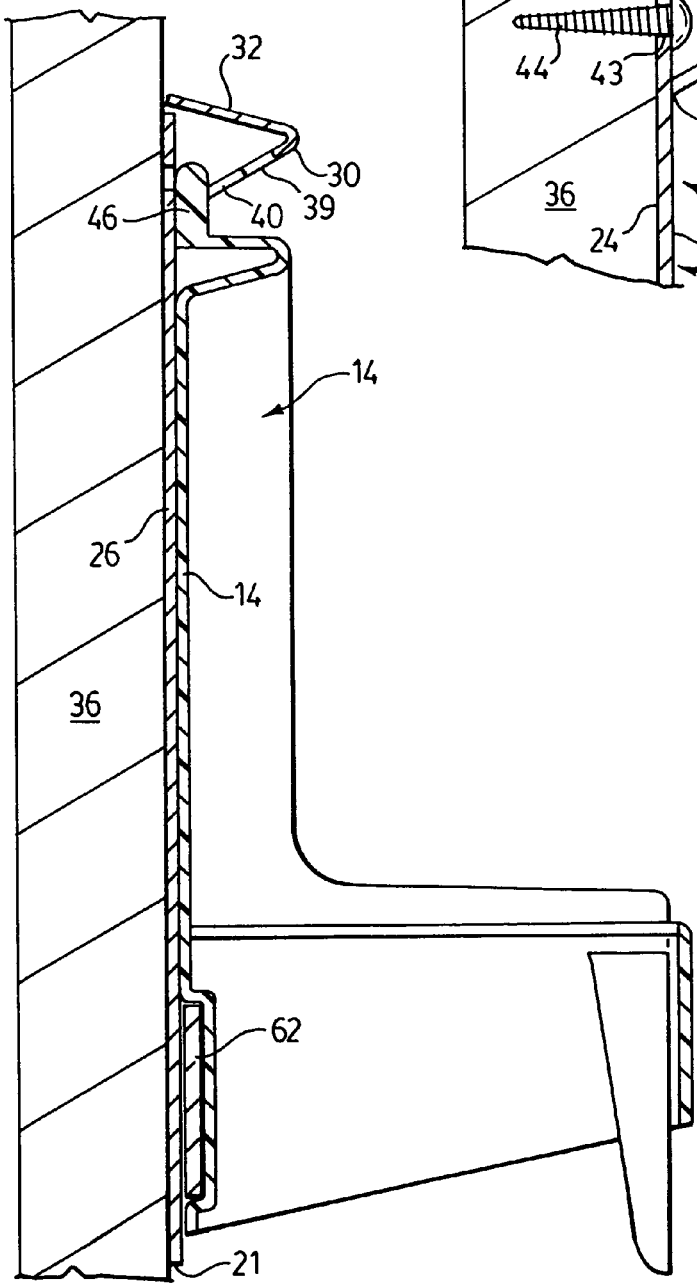
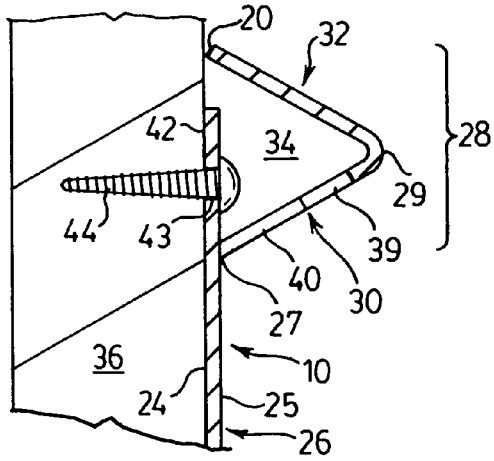
FIG. 4.

FIG. 5.
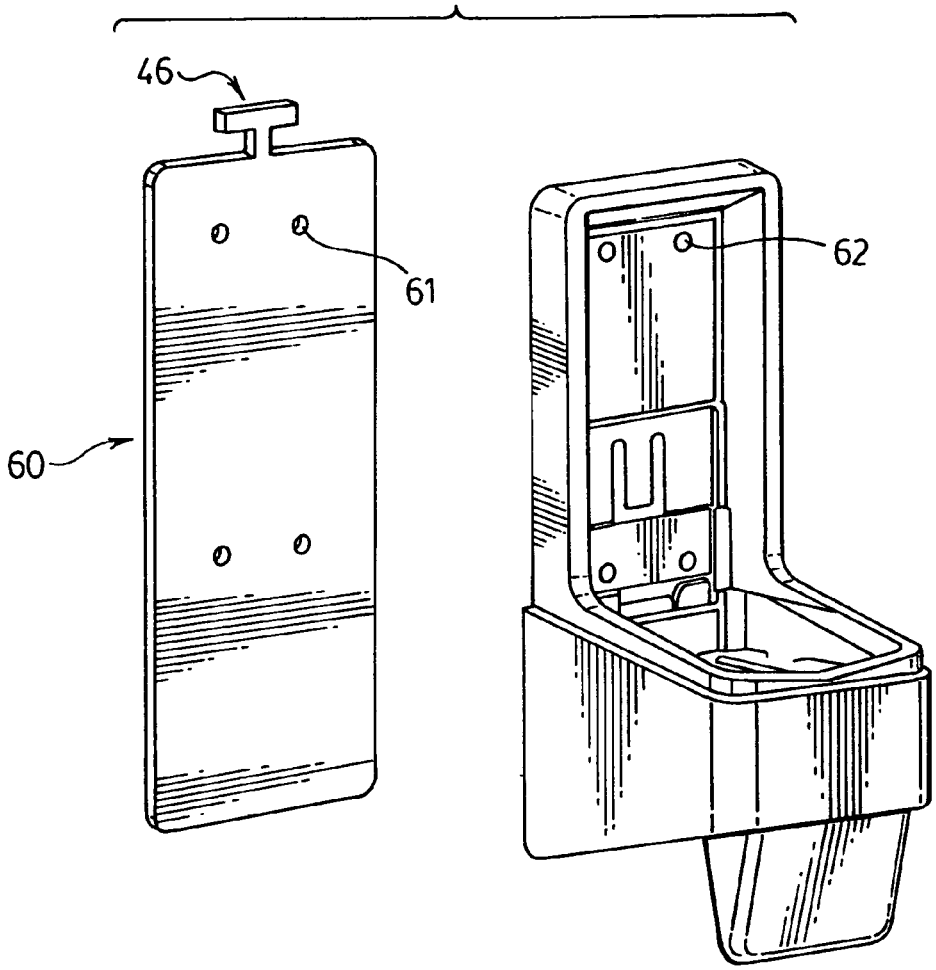
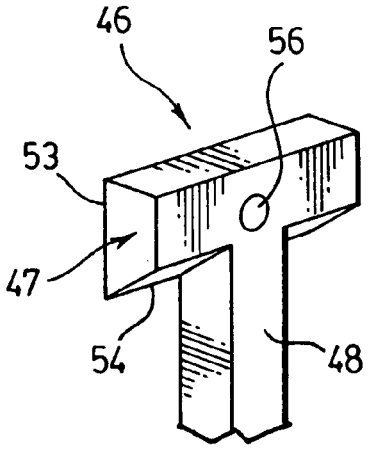
FIG. 6.

WALL PLATE SYSTEM FOR DISPENSERS

SCOPE OF THE INVENTION

This invention relates to a wall plate for mounting to a wall and upon which dispensers such as soap dispensers, may be readily secured and removed.

BACKGROUND OF THE INVENTION

In hospital environments, many different types of dispensers are mounted to walls, such as, liquid dispensers including soap dispensers and dispensers for alcohol cleaning solutions. Typical, such dispensers are mounted to walls by the use of fasteners, such as, screws with or without wall anchors and by the use of adhesives. A disadvantage of the use of screws is that holes are created in the wall by the screws themselves or by the anchors for the screws and that the anchors often remain embedded in the wall and are difficult to remove. In any event, the removal of the screws and/or the removal of the wall anchors causes damage to the wall and leaves unsightly holes. A disadvantage of the use of adhesives is that on removal of the dispenser from a wall, the surface of the wall which is typically painted or has some other form of wall covering is removed or marred or otherwise damaged in an unsightly manner. Not only for decorative reasons but also for sanitary reasons, it is preferred that any damage caused by the removal of a dispenser be repaired with resultant additional cost.

Many dispensers have a useful life after which they need to be replaced. Often times, the costs of removal of an existing dispenser, repair of the wall upon which is mounted and mounting of a new dispenser is a significant cost relative to the cost of a new dispenser.

SUMMARY OF THE INVENTION

To at least partially overcome these disadvantages of previously known devices, the present invention provides a wall plate for mounting to a wall upon which wall plate dispensers may readily be secured and removed.

An object of the present invention is to provide a universal wall plate which can be secured to a wall and to which a variety of dispensers can readily be secured and removed with minimal effort, without the need to remove the wall panel and without causing damage to the wall. Another object is to provide a simplified arrangement for mounting and removing dispensers to a wall.

In accordance with the present invention, a wall plate system is provided for mounting dispensers to a wall. The system includes as components, a wall plate adapted for securing to the wall and one or more dispensers each of which are adapted to be removably coupled to the wall plate. The wall plate is secured to the wall and carries preferably at an upper end a securement portion as preferably an outwardly extending flange which carries engagement elements providing a quick connect and quick disconnect arrangement for interaction with an engagement member carried on each of the dispensers adapted to be coupled to the wall plate. The engagement member carried each of the dispensers is preferably provided at an upper end of the dispenser such that the dispenser may be engaged at its upper end to the outwardly extending flange and hang downwardly therefrom supported at its upper end. The engagement member may preferably be provided as an integral portion of the dispenser, as for example, as a portion of a plastic member forming a back plate of the dispenser. The engagement member may be a separate adaptor to be coupled to the dispenser as, for example, as a preferably thin member attached to the rear of the dispenser and providing the engagement member. While not necessary, preferably some means may be provided for attachment of a rear surface of the dispenser below its upper end to a plate portion of the wall plate which extends downwardly on the wall from the outwardly extending flange. Preferred arrangements can include magnets and releasable adhesives. The wall plate is to be relatively permanently secured to a wall as by fasteners, such as, screws with or without wall anchors or adhesives. Once the wall plate is attached to a wall, any dispenser having complementary engagement members may be easily coupled to the wall plate for use or uncoupled for replacement by the same dispenser or other dispensers having appropriate complementary engagement members.

The wall plate may have a number of engagement elements so as to permit more than one dispenser to be provided on the wall plate, or any one dispenser to be coupled by two or more engagement members.

The nature of the dispensers are preferably to be selected from: soap dispensers as for washing hands as in a washroom context; fluid dispensers for dispensing, cleaning and disinfecting solutions, such as, alcohol based solutions for use by medical personnel in hospitals; dispensers of paper towels and serviettes for drying hands; and dispensers of air freshener. However, the wall plate may be used for mounting and demounting any manner of devices which may be desired to be secured to a wall and may reasonably be expected to be removed as for repair or replacement, particularly, where the replacement may have a different foot print. Such devices include smoke and fire alarms, thermometers, and fire extinguishers.

In one aspect, the present invention provides a wall plate system comprising: a wall plate adapted for securing to a wall by fastening mechanism selected from fasteners which extend rearwardly of the wall plate into the wall and adhesives, a plurality of dispensers each of which are adapted to be removably coupled to the wall plate, the wall plate having an upper edge, a lower edge, and two side edges, the wall plate having a securement portion and a plate portion, the securement portion disposed along the upper edge, the plate portion coupled to the securement portion and extending therefrom between the two side edges to the lower edge, the plate portion comprising a thin planar sheet member having a rear surface and a front surface, the securement portion having a rear surface disposed in the same plane as the rear surface of the plate portion or forward thereof, the securement portion carrying an engagement element, the dispenser having an upper end, a lower end and a rear surface for engagement with forward surface of the plate portion, the dispenser carrying at its upper end an engagement member removably engaging the engagement element of the securement portion to removably secure the dispenser to the wall plate with the rear surface of the dispenser in engagement with the forward surface of the plate portion with the upper end of the dispenser proximate the securement portion and with the dispenser extending downwardly from its upper end to its lower end, wherein with the wall plate secured to a wall with a first of the dispensers coupled to the wall plate by engagement between the engagement element of the wall plate and the engagement member of that first dispenser, without removal or disengagement of the wall plate from the wall, the first dispenser is removable from the wall plate by disengagement of the engagement between the engagement element of the wall plate and the engagement member of that first dispenser for replacement as by a second of the plurality of dispensers by engagement between the engagement element of the wall plate and the engagement member of that second dispenser.

BRIEF DESCRIPTION OF THE DRAWINGS

Further aspects and advantages of the present invention will become apparent from the following description taken together with the accompanying drawings in which:

FIG. 3 is a schematic vertical cross-sectional side view along section line 3-3' in FIG. 2;

FIG. 4 is an enlarged view of a portion of FIG. 3 but showing merely the wall plate and wall;

FIG. 5 is an exploded perspective view showing an adaptor plate together with a back plate for a dispenser in accordance with a second embodiment;

FIG. 6 is a pictorial view of a third embodiment of a T-shaped key member;

DETAILED DESCRIPTION OF THE DRAWINGS

Figure 1:
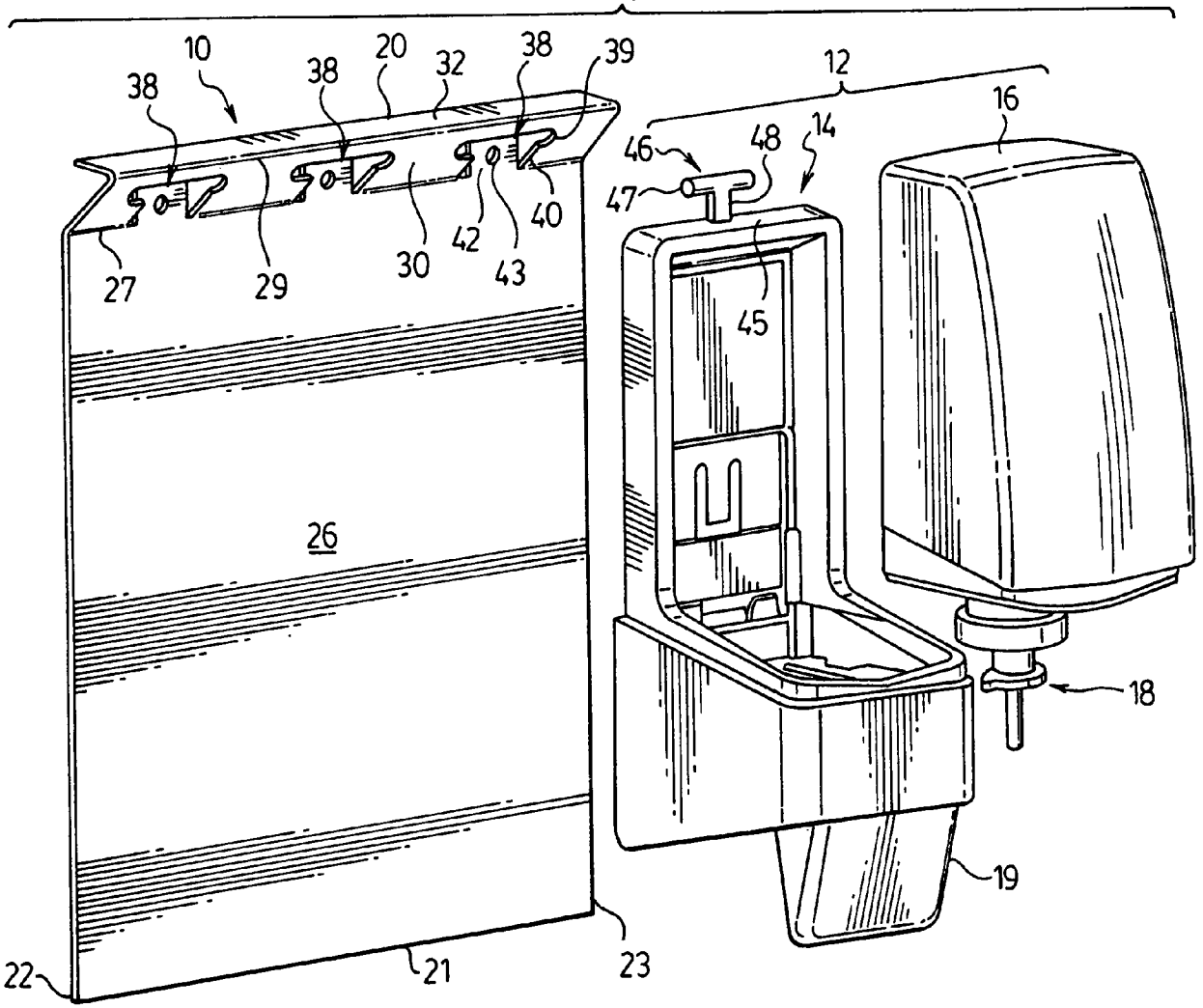
FIG. 1 is an exploded perspective view of a wall plate system in accordance with a first embodiment of the present invention.

Reference is made first to FIG. 1 which illustrates an exploded view of the wall plate system in accordance with the present invention and including a wall plate 10 adapted for securing to a wall and a dispenser 12 adapted to be removably coupled to the wall plate 10. The dispenser 12 comprises a back plate 14 and a replaceable fluid reservoir 16 with an attached pump 18. In a known manner, the fluid reservoir 16 and pump 18 are removably coupled to the back plate 14 in a manner that manual rearward pressing on an actuation lever 19 will dispense fluid downwardly as on to the hand of a user below the dispenser.

The wall plate 10 has an upper edge 20, a lower edge 21 and two side edges 22 and 23. The wall plate 10 illustrated is formed from a unitary sheet of metal having a rear surface 24 and a forward surface 25. The wall plate 10 has a plate portion 26 which extends between the side edges 22 and 23 from the lower edge 21 to a first fold line 27. The wall plate 10 has a securement portion 28 which comprises the wall plate 10 from the first fold line 27 between the side edges 22 and 23 to the upper edge 20. The wall plate 10 extends from the first fold line 27 forwardly and upwardly at a diagonal to a plane in which the plate portion 26 lies to a second fold line 29 and hence from the second fold line 29 rearwardly and upwardly at an angle to the upper edge 20. The upper edge 20 is disposed in the same plane as a plane through the rear surface 24 of the plate portion 26.

The securement portion 28 is in the form of a channelway member extending longitudinally along the upper edge 20 of the wall plate open at its rear and closed at its front by a lower flange 30 between the first fold line 27 and the second fold line 29 and an upper flange 32 between the second fold line 29 and the upper edge 20. The securement portion 28 as such a channelway member defines a channelway 34 therein open rearwardly but however to be closed by a wall 36 to which the wall plate 10 is to be attached as illustrated in FIG. 4.

Figure 2:
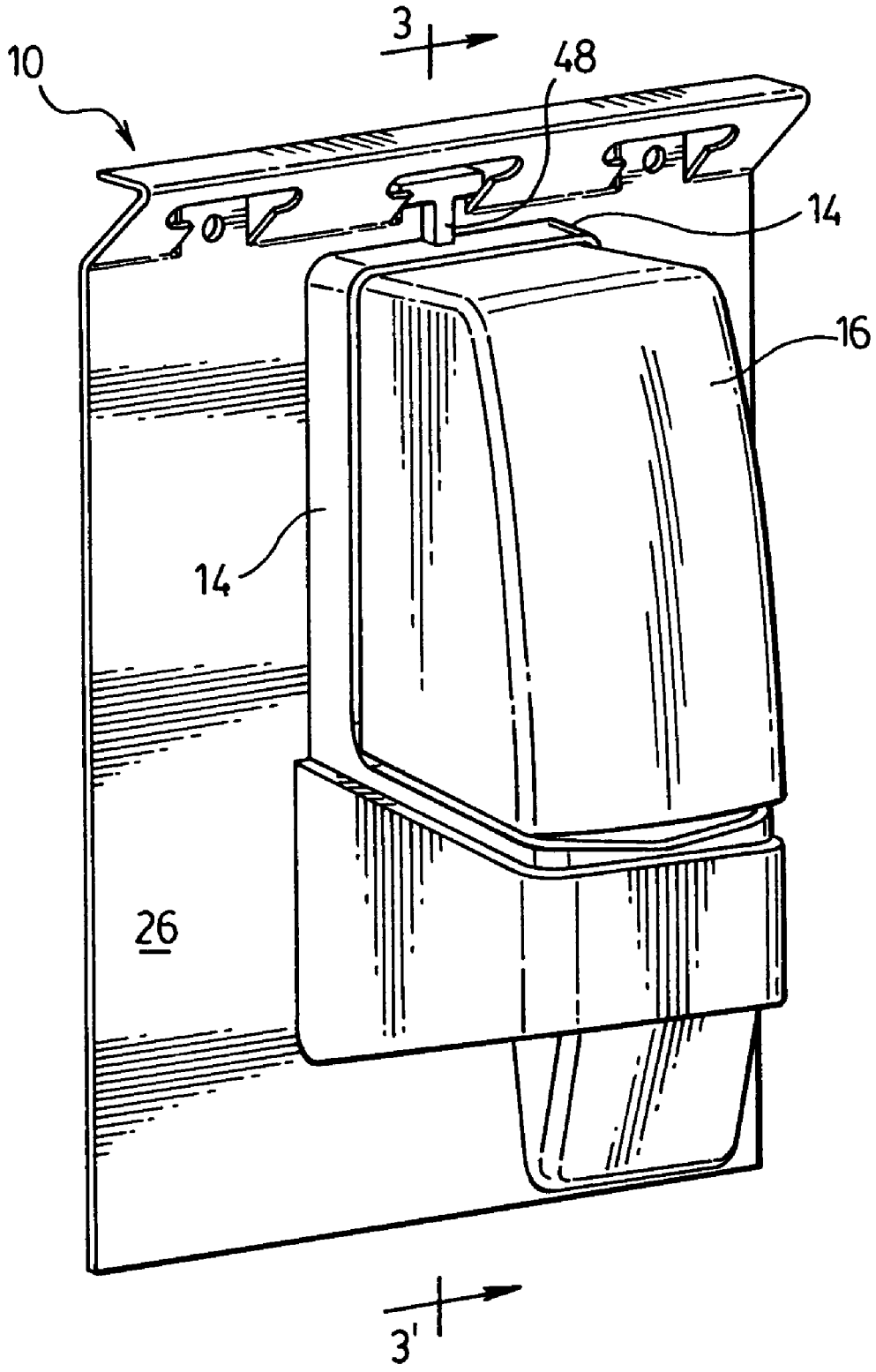
FIG. 2 is a perspective view showing the wall plate system of FIG. 1 with the dispenser secured to the wall plate.

As seen in FIGS. 1 and 2, a plurality of generally T-shaped keyway openings 38 extend through the lower flange 32 into the channelway 34. The keyway openings 38 have a generally T-shaped in appearance with an enlarged width upper passage portion 39 and a reduced width lower catch portion 40.

As shown, centered on each keyway openings 38 is a securement tab 42 which is an extension of the plate portion 26 which extends upwardly from the location of the first fold line 27, is disposed in the plane of the plate portion 26 and carries a hole 43 therethrough. As seen in FIG. 4, the wall plate 10 may be secured to a wall 36 by the use of screws 44 which pass through these holes 43 in the tabs 42 and fixedly locate the wall plate 10 on the wall 36 with the rear surface 24 of the plate portion 26 flush with the surface of the wall.

The back plate 14 of the dispenser 12 carries at its upper end 45 a key member 46 generally in the shape of a "T" as seen in front view and having an enlarged width digital tab portion 47 sized to pass through the upper passage portion 39 of the keyway opening 38 however a sufficient width do not pass through the lower catch portion 40 of the keyway opening 38. The distal tab portion 47 is connected to the back plate 14 via a bridge portion 48 sized to be of a width less than the width of the lower catch portion 40 of the keyway opening 38.

To couple the dispenser 12 to the wall plate 10, the dispenser 12 is manually manipulated and positioned such that the distal tab portion 47 of the key member 46 is passed through the upper passage portion 39 of the keyway opening 38 into the channelway 34 and then moved downwardly inside the channelway 34 with the bridge portion 48 of the key member 46 extending through the lower catch portion 40 of the keyway opening 38 and the distal tab portion 47 engaging the rear surface of the lower flange 30 in the channelway 34 on either side of the lower catch portion 40 of the keyway opening 38. With the key member 46 so engaged in the keyway opening 38, the dispenser 12 may be released and will hang supported at its upper end 45 by the key member 46 being engaged in the keyway opening 38. The dispenser 12 hangs vertically downwardly with a rear surface of its back plate 14 planar with the forward surface 25 of the plate portion 26. For removal, the process is reversed and the dispenser 12 is manipulated and moved upwardly such that the distal tab portion 47 of the key member 46 is moved upwardly and then forwardly out through the upper passage portion 39 of the keyway opening 38.

In the embodiment of FIG. 1, the wall plate 10 is shown as having three separate keyway openings 38 each of which is adapted to receive a key member 46 of the dispenser. The dispenser 12 may thus be mounted in any one of the three locations. Alternatively, two dispensers may be mounted one on each of the outermost keyway openings 38. Further, a single dispenser may be provided which have two or more key members 46 spaced laterally from each other to be engaged within two of the keyway openings 38. Providing a dispenser to have at least two laterally spaced key members 46 to engage in two laterally spaced keyway openings 38 can assist in providing increased stability and resistance to side-to-side movement of the dispenser in use.

Wall plate 10 is illustrated as being a rectangular plate which has a width greater than the width of the dispenser 12 shown. It is to be appreciated that the wall plate 10 may be provided in different widths. For example, the wall plate 10 could be provided to a width as great as possible having regard to space available on a wall and to provide as many keyway openings 38 as may be desired as for mounting of multiple dispensers or other devices. Alternatively, the wall plate 10 may be sized to a width merely identical to that of a dispenser 12 to be mounted. The wall plate 10 preferably does not have any structure which extends outwardly from the wall below the securement portion 28 beyond the forward surface 25 of the plate portion 26 so that dispensers which have a vertical length greater than the length of the plate portion 26 may extend downwardly beyond the lower edge 21. The wall plate 10 may be selected to have dimensions so as to cover damaged surfaces of a wall. The wall plate 10 may preferably be formed by bending a metal sheet. Preferably, the wall plate 12 may comprise a sheet of stainless steel or a galvanized or powder-coated or otherwise painted metal so as to provide a pleasing yet sanitary decorative surface.

While a wall plate is preferably formed from a sheet of metal, it is to be appreciated this is not necessary and it may be formed from various other materials including plastic materials.

The wall plate 10 is preferably secured to the wall merely by screws or other fasteners extending through the holes 43 in the securement tabs 42 of the securement portion 28 into the wall or anchors in the wall. Various other means may be provided for securement of the wall plate to the wall. For example, screw openings (not shown) could be provided at the lower corners of the wall plate 10 through which screws could be driven through the wall plate into a wall with such screws preferably having heads which would not interfere with dispensers mounted on the wall plate. The wall plate may also be secured to the walls as by the use of nails or rivet like devices or by the use of adhesives which could be applied to the rear surface 24 of the plate portion 26. Where screws are used to pass through the holes 43 in the securement tabs 42 at the upper end of the wall plate 10, use of a small amount of adhesive along the rear surface of the wall plate proximate its lower edge 21 may be advantageous. Preferably, screws used to secure the wall plate 10 to a wall pass through the securement portion 28 whereby heads of such screws may be substantially hidden and/or located to not interfere with the dispensers.

While not necessary, when the dispenser 12 is coupled to the wall plate 10 and hangs downwardly from the wall plate 10 as illustrated in FIG. 2, some mechanism may be provided to secure another portion of the dispenser to the wall plate, preferably proximate the lower end 50 of the dispenser 12. One preferred manner of accomplishing this is by the use of a permanent magnet, for example, to provide the plate portion 26 as being or having a portion which is a metal to which a permanent magnet is attracted. As seen in FIG. 3, a permanent magnet 62 may then be secured in the back plate 14 of the dispenser 12 preferably flush with the rear surface of the back plate 14 and located to overlie the metal portion of the plate portion 26 and securely engage by magnetic forces the back plate 14 proximate its lower end 21 to the plate portion 26.

Rather than use of such magnetic coupling mechanism, an adhesive may be applied to the lower rear surface of the back plate 14 to adhesively bond the back plate 14 to the forward surface 25 of the plate portion 26. Such adhesives may be selected such that for the application of forces less than forces which would cause damage to the dispenser 12 or to the wall plate 10, the adhesive bond may itself fail or fail in its adhesion to either the wall plate 10 or to the dispenser 12. The adhesive preferably would be provided such that it may be readily removed at least from the wall plate 10 as by mechanical scraping or chemical dissolution. It is not necessary however that the dispenser 12 be secured other than by hanging from its key member 46.

Rather than use of magnetic coupling devices, suction cups could be secured on the rear of the back plate 14 of the dispenser 12 for secure removable coupling with the plate portion 26.

While screws could be provided to pass through the back plate 14 of the dispenser and through the plate portion 26, this is generally not desired as it would leave holes through the plate portion 26.

In the preferred embodiment shown in FIG. 1, the back plate 14 of the dispenser 12 and the key member 46 are formed as an integral member as by injection molding from plastic. This is not necessary and the key member 46 may be provided as a separate element as for a securement to an existing back plate of the dispenser. In this regard, reference is made to FIG. 5 showing an adaptor plate 60 for securing to a back plate 14 for a dispenser which does not have the key member 46. Rather, the adaptor plate 60 carries the key member 46. The adaptor plate 60 may be secured to the rear of the back plate 14 as by screws, rivets and the like through complementary holes 61 and 62, or by mechanical interaction of features or outwardly extending flanges or plates and the like of the sheet metal plate with complementary structure on the back plate, preferably such that the securing mechanism does not extend rearwardly beyond a planar rear surface of the adaptor plate 60. The adaptor plate 60 can be fashion as by stamping from a planar sheet of material which may comprise, for example, merely a sheet of metal or a laminate comprising a sheet of metal covered on its rear by a layer of material which is a permanent magnetic attractive to the wall plate 10, such layers of magnetic material may comprise a flat relatively thin (about 1/16 to 1 inch) magnetized iron or steel sheet material or of a rigid or flexible non-magnetic synthetic resinous plastic such as polystyrene, polypropylene, acrylic, or the like, having finely divided magnetic particles distributed throughout the body.

Typically, back plates are adapted for mounting to a wall as by passing screws through openings therein. Such openings may be used, for example, for connection to an adaptor member 60 carrying the key member 46. Preferably, the arrangement of the key member when secured as a separate element to the back plate of the dispenser will be arranged so as to minimize any spacing of the rear surface of the back plate of the dispenser from the front surface of the wall portion.

The keyway openings 38 on the securement portion 28 provide in effect an engagement element on the securement portion 28. The key member 46 on the dispenser 12 effectively comprises an engagement member on the dispenser which is adapted to engage the engagement element on the securement portion 28 to removably secure the dispenser 12 to the wall plate 10. It is to be appreciated that these elements could be reversed as, for example, with a key member provided on the securement portion 28 and the keyway openings 38 provided in the upper end of the back plate 14 of the dispenser.

The particular nature of the engagement element and complementary engagement member to be provided on the dispenser or wall plate or vice versa is not limited. Various hooks, catches, ball-in-socket, dovetail, wedging and other catch type complementary engagement arrangements may be used.

In the preferred embodiment, from the position illustrated in FIG. 2, the dispenser 12 may be pivoted about a laterally extending axis through the distal tab portion 47 so as to move a lower portion of the dispenser 12 forwardly away from the plate portion 26. The configuration of the distal tab portion 47 may be selected such that it may only pass through the upper passage portion 39 of the keyway openings 38 when the dispenser 12 is pivoted to be in a position at a selected angle to the vertical that is, for example, at 45° or 90° and that once the distal tab portion 47 is inserted in this desired angle orientation through the upper passage portion 39, on rotation of the dispenser 12 downwardly, the distal tab portion 47 assumes angular orientations in which its vertical height is greater than the vertical height of the upper passage portion 39. It is to be appreciated that this can be accomplished by having the distal tab portion 47 sized to have a rectangular shape as schematically shown in the embodiment of FIGS. 6 to 8 with such rectangular shape only being permitted to pass through the upper passage portion 39 when the rectangular shape is disposed such that its side surfaces 52 are normal to the surface of the lower flange 30, as seen in FIG. 8.

Figure 7:
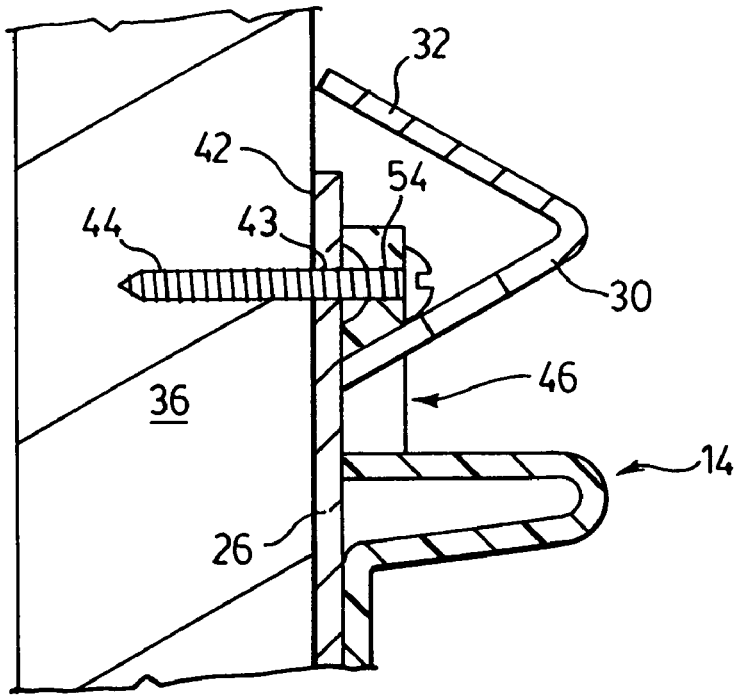
FIG. 7 is a side view similar to FIG. 4 but showing the key member of FIG. 6.
Figure 8:
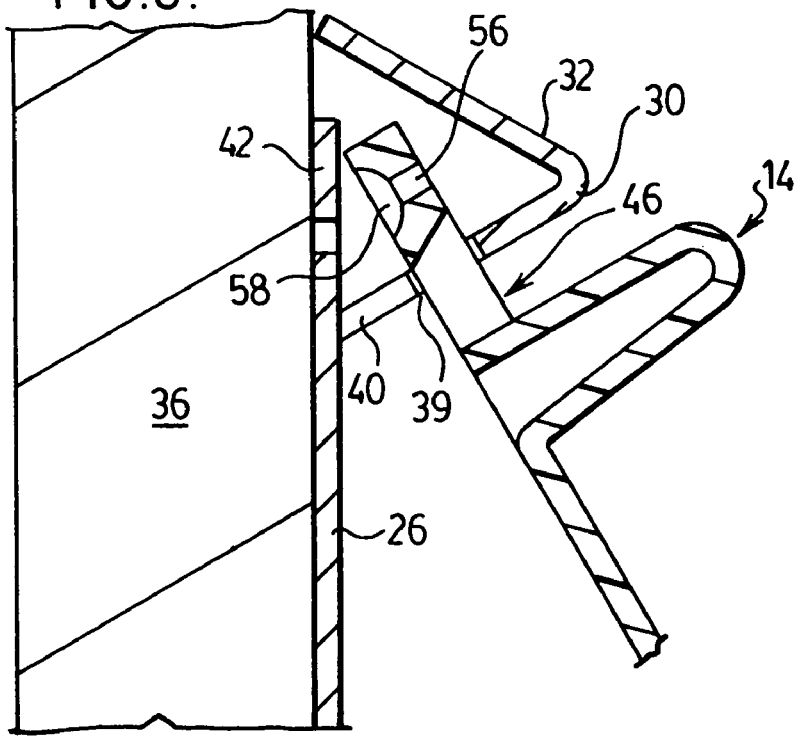
FIG. 8 is a side view similar to FIG. 7 but showing insertion of the key member of FIG. 6.

In the embodiment shown in FIGS. 6 to 8, the distal tab portion 47 has a flat rear surface 53 and to have a bottom surface 54 which is disposed to extend forwardly and upwardly at an angle substantially identical to the angle of the rear surface of the lower flange 30. On the distal tab portion 47 being placed inside the channelway 34 and being drawn vertically downwardly by the weight of the dispenser 12, the rear surface 53 of the distal tab portion 47 engages vertical forward surface of the securement tab 42 and the bottom surface 54 of the distal tab portion 47 engages the rear surface of the lower flange 30 thus tending to locate and secure the distal tab portion 47 against rotation so as to locate the dispenser 12 with its rear surface vertical and in close engagement with the forward surface 25 of the plate portion 26. Other arrangements for engagement between the engagement element and the engagement member may cause or bias the dispenser 12 to hang with its rear flush with the plate portion 26.

The key member 46 need not be of a T-shaped as shown but may have many other shapes including a distal tab portion which is ball shaped, of a generally dovetail shape and various other shapes which can be complementary for engagement between an engagement element on the securement portion and an engagement member on the dispenser.

Preferably, the engagement element on the securement portion may be provided on the generally downwardly directed lower flange 30 so as to improve the appearance when the wall plate is secured to a wall and often is seen from above. Various other forms of securement portions including these having channel members may be secured to the top of the plate portion and may be, for example, bent into different shapes. The securement portion may comprise a plastic or metal member formed as by extrusion and from which the engagement element or engagement member be cut out or attached.

The preferred embodiment shows screws 44 extending through the holes 43 in the securement tab 42 to secure the wall plate 10 to the wall. The embodiment illustrated in FIGS. 6 to 8 is provided with an opening 56 through the key member 46 which opening is adapted to align with a hole 43 through the securement tab 42. This opening 56 may have an enlarged rear portion 58 so as to fit over a head of a screw received on the securement tab 42. Alternatively, a screw through the securement tab 42 may be removed and after the dispenser has been engaged with the securement portion, the same or a longer screw 44 may be passed through the opening 56 in the key member 46, through the hole 43 in the securement tab 42 and into the wall 36 as seen in FIG. 7 to assist in rigidly securing the back plate 14 on top of the wall plate 10 against movement or removal.

Figure 9:
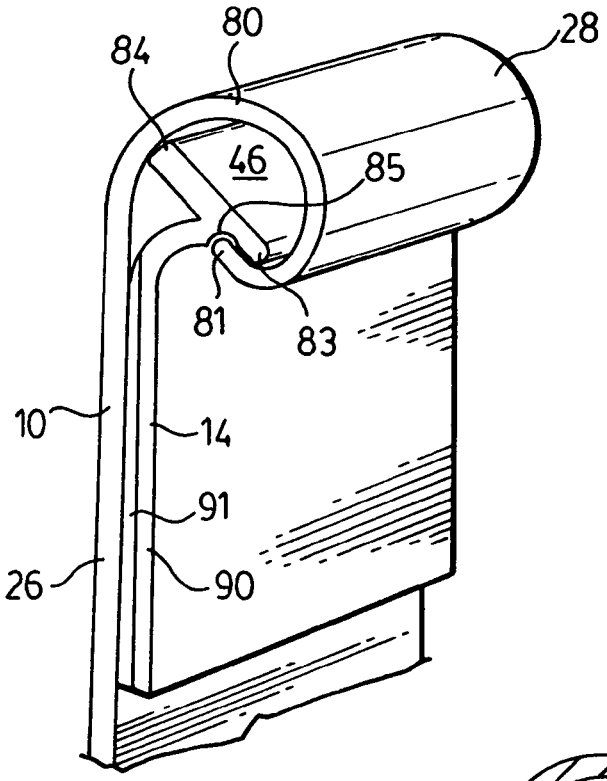
FIG. 9 is a schematic pictorial view of a wall plate and dispenser back plate in accordance with a fourth embodiment of the invention assembled.
Figure 10:
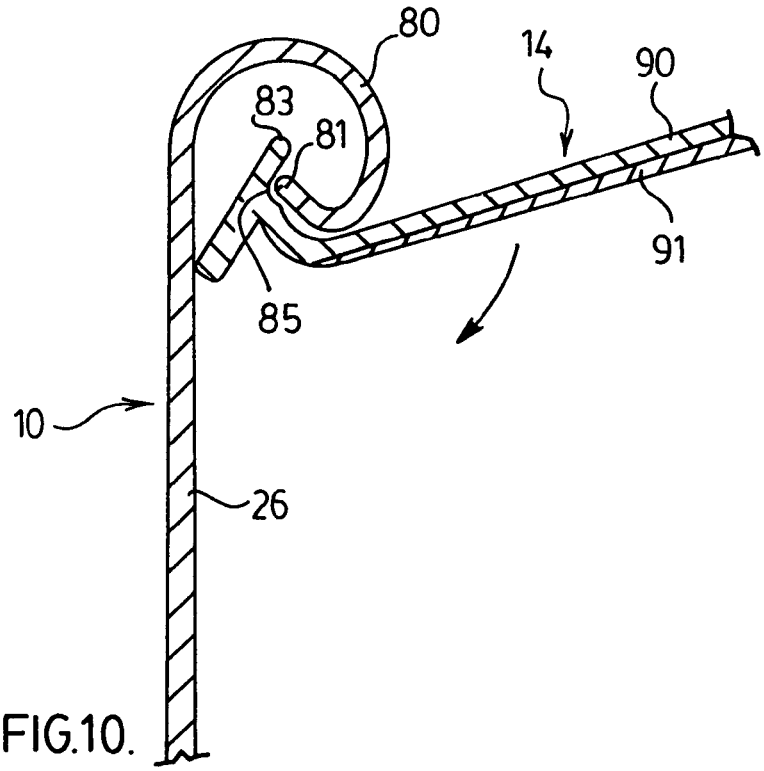
FIG. 10 is a side view of the embodiment of FIG. 9 being assembled.

Reference is made to FIGS. 9 and 10 showing schematically a fourth embodiment of a wall plate 10 with a securement portion 28 formed as a resilient, curved member 80 with an upwardly and rearwardly directed distal end 81. The back plate 14 carries as a key member 46 a wedge member having a first end 83, a second end 84 and a pivot recess 85. The key member 46 may be positioned as seen in side view in FIG. 10 with the first end 83 inside the curved member 80 and the distal end 81 in the pivot recess 85, and from this position pivoted clockwise to urge the distal end 81 outwardly so that the key member 46 may come to assume the engaged position seen in FIG. 9 to which it is biased by the resiliency of the curved member 80. FIGS. 9 and 10 also show the back plate 14 as having a planar portion formed as a laminate with a front layer 90 of metal and a rear layer 91 of a permanent magnet which will adhere to the front surface of the plate portion 26.

While the invention has been described with reference to preferred embodiments, many modifications and variations will now occur to persons skilled in the art. For a definition of the invention, reference is made to the following claims.

The invention claimed is:

1. A wall plate system comprising:

a wall plate adapted for securing to a wall by fastening mechanism selected from fasteners which extend rearwardly of the wall plate into the wall, a plurality of dispensers each of which are adapted to be removably coupled to the wall plate, the wall plate having an upper edge, a lower edge, and two side edges, the wall plate having a securement portion and a plate portion, the securement portion disposed along the upper edge, the plate portion coupled to the securement portion and extending therefrom between the two side edges to the lower edge, the plate portion comprising a thin planar sheet member having a rear surface and a forward surface, the securement portion having a rear surface disposed in the same plane as the rear surface of the plate portion or forward thereof, the securement portion carrying an engagement element, each dispenser having an upper end, a lower end and a rear surface for engagement with the forward surface of the plate portion, each dispenser carrying at its upper end an engagement member removably engaging the engagement element of the securement portion to removably secure each dispenser to the wall plate with the rear surface of each dispenser in engagement with the forward surface of the plate portion with the upper end of each dispenser proximate the securement portion and with each dispenser extending downwardly from its upper end to its lower end, wherein with the wall plate secured to a wall with a first of the plurality of dispensers coupled to the wall plate by engagement between the engagement element of the wall plate and the engagement member of that first dispenser, without removal or disengagement of the wall plate from the wall, the first dispenser is removable from the wall plate by disengagement of the engagement between the engagement element of the wall plate and the engagement member of that first dispenser for replacement as by a second of the plurality of dispensers by engagement between the engagement element of the wall plate and the engagement member of that second dispencer, the wall plate is formed by bending a single metal sheet, the metal sheet being bent at a juncture between the plate portion and the securement portion to provide the securement portion as extending forwardly from the plane of the plate portion permitting each dispenser to hang downwardly from the securement portion, the securement portion comprises an elongate channel member extending along the upper edge of the wall plate parallel to the upper edge defining a hollow channelway therein, the engagement element comprising a keyway opening through the channel member into the channelway, the engagement member comprising a key member adapted to extend through the keyway at least partially into the channelway to couple each dispenser to the securement portion against removal with each dispenser to hang downwardly from the securement portion, the metal sheet is a flat planar sheet other than along the upper edge of the wall plate where the metal sheet is bent to form the elongate channel member extending forwardly from the plane of the plate portion and defining the hollow channclway therein forwardly from the plane of the plate portion, the metal sheet is bent along a first fold line parallel to the upper edge between the plate portion and the channel member providing a forwardly and upwardly extending lower flange of the channel member ending at a second fold line parallel to the first fold line and providing a rearwardly extending upper flange ofthe channel member, the hollow channelway defined rearwardly of and between the lower flange and the upper flange, and the keyway is provided through the lower flange.

2. A wall plate system as claimed in claim 1 wherein the keyway and the key member are complementary so as to provide for connection and disconnection by manipulating the relative position of each dispenser and its key member relative to the securement portion.

3. A wall plate system as claimed in claim 1 including a secondary engagement mechanism removably securing the lower end of each dispenser to the forward surface of the plate portion of the wall plate when the engagement element and the engagement member are engaged and release of the secondary engagement mechanism is required to disconnect the engagement element and the engagement member.

4. A wall plate system as claimed in claim 3 wherein the secondary engagement mechanism comprises a magnetic mechanism with the plate portion being magnetic and each dispenser carrying proximate its lower end a permanent magnet which is magnetically attracted to the plate portion underlying the magnet.

5. A wall plate system as claimed in claim 4 wherein each dispenser is removed from the wall plate and secured to the wall plate via relative coupling or uncoupling of the engagement element and the key member and coupling or uncoupling of the secondary engagement mechanism manually without the use of tools and without removing the wall plate from its securement to the wall.

6. A wall plate system as claimed in claim 3 wherein the secondary engagement mechanism comprises an adhesive between the rear surface of each dispenser and the forward surface of the plate portion, the adhesive adhering to the forward surface of the plate portion such that the bond may be broken by the application of forces between the plate portion and each dispenser and which adhesive may be removed from adherence to the plate portion.

7. A wall plate system as claimed in claim 1 wherein the keyway and the key member engage each other to permit relative pivoting of each dispenser relative the wall plate about a pivot axis parallel to and proximate the upper edge of the wall plate without disengagement of the keyway and the key member.

8. A wall plate system as claimed in claim 7 wherein the keyway provides an opening with an upper passage portion open into and above a lower catch portion, the key member having a distal tab portion sized to pass through the upper passage portion and sized to not pass through the lower catch portion, the tab portion insertable into the keyway through the upper passage portion and then moved downwardly relative the keyway to be received relative the lower catch portion in a position which the tab portion and lower catch portion engage to prevent removal without upward movement of each dispenser.

9. A wall plate system as claimed in claim 1 wherein the keyway and the key member engage each other to permit relative pivoting of each dispenser relative the wall plate about a pivot axis parallel to and proximate the upper edge of the wall plate.

10. A wall plate system as claimed in claim 1 wherein the securement portion includes openings for passage of fasteners through the securement portion into the wall to secure the wall plate to the wall.

11. A wall plate system as claimed in claim 1 wherein each dispenser includes a rear mounting plate removably coupled to the remainder of each dispenser, the rear mounting plate carrying at an upper end thereof the key member.

12. A wall plate system as claimed in claim 1 wherein the keyway provides an opening with an upper passage portion open into and above a lower catch portion, the upper passage portion having a width parallel the upper edge greater than a width of the lower catch portion parallel the upper edge.

13. A wall plate system as claimed in claim 12 wherein centered on each keyway is a securement tab which is an extension of the plate portion, which extends upwardly from the location of the first fold line and which is disposed in the plane of the plate portion.

14. A wall plate system as claimed in claim 13 wherein the securement tabs carry a hole therethrough.

15. A wall plate system as claimed in claim 14 wherein screws pass through these holes in the securement tabs.

16. A wall plate system as claimed in claim 13 wherein the key member having a T-shape and the keyway having a complementary T-shape.

17. A wall plate system as claimed in claim 16 wherein the key member having a distal head-like tab portion and a connecting leg portion normal thereto, the keyway having an upper passage portion extending parallel to the upper edge and a lower leg-like catch portion extending normal thereto, the tab portion having a width sized to pass through the passage portion of the keyway when the tab portion is extending parallel to the upper edge, the tab portion sized to not pass through a lower leg-like catch portion of the keyway when the tab portion is extending parallel to the upper edge, with the tab portion extending parallel to the upper edge the tab portion insertable into the channelway through the upper passage portion and with the tab portion rearward of the lower flange and the leg portion of the key member extending forwardly through the catch portion of the keyway the key member is movable downwardly relative the keyway to have the tab portion received rearward of the catch portion in a position which the tab portion and catch portion engage to prevent removal of the key member from the keyway without upward movement of each dispenser.

18. A wall plate system as claimed in claim 1 wherein the keyway is one of a plurality of identical keyways provided through the lower flange.

* * * * *